US008069600B2

(12) United States Patent
Rousseau et al.

(10) Patent No.: US 8,069,600 B2
(45) Date of Patent: Dec. 6, 2011

(54) MULTI-CALIBER BOLT FOR A FIREARM

(75) Inventors: Joseph F. N. Rousseau, Mountain Green, UT (US); Peter Sodoma, Layton, UT (US); David L. Hurst, West Haven, UT (US)

(73) Assignee: Browning, Morgan, UT (US)

( * ) Notice: Subject to any disclaimer, the term of this patent is extended or adjusted under 35 U.S.C. 154(b) by 427 days.

(21) Appl. No.: 11/971,690

(22) Filed: Jan. 9, 2008

(65) Prior Publication Data

US 2010/0281734 A1 Nov. 11, 2010

(51) Int. Cl.
*F41A 15/14* (2006.01)
*F41A 3/12* (2006.01)

(52) U.S. Cl. ..... 42/25; 42/69.02

(58) Field of Classification Search ..... 42/25, 46, 42/68, 69.02, 16
See application file for complete search history.

(56) References Cited

U.S. PATENT DOCUMENTS

| | | | | |
|---|---|---|---|---|
| 557,360 | A | | 3/1896 | Burgess |
| 618,033 | A | | 1/1899 | Hemming |
| 1,373,888 | A | | 4/1921 | Johnson |
| 2,447,091 | A | * | 8/1948 | Pope ..... 42/76.01 |
| 3,306,168 | A | * | 2/1967 | Blumrick ..... 89/191.01 |
| 3,776,095 | A | * | 12/1973 | Atchisson ..... 89/128 |
| 3,780,618 | A | * | 12/1973 | Sanford ..... 89/150 |
| 3,967,404 | A | * | 7/1976 | Reynolds ..... 42/25 |
| 4,654,993 | A | * | 4/1987 | Atchisson ..... 42/71.01 |
| 5,410,834 | A | * | 5/1995 | Benton et al. ..... 42/75.02 |
| 5,499,569 | A | * | 3/1996 | Schuetz ..... 89/197 |
| 5,540,008 | A | | 7/1996 | Kirnstatter |
| 5,678,340 | A | * | 10/1997 | Moon ..... 42/25 |
| 5,768,815 | A | * | 6/1998 | Casull ..... 42/46 |
| 5,794,373 | A | * | 8/1998 | Moon ..... 42/25 |
| 6,609,319 | B1 | * | 8/2003 | Olson ..... 42/16 |
| 6,739,082 | B2 | | 5/2004 | Christensen |
| 6,851,212 | B2 | * | 2/2005 | Szabo ..... 42/25 |
| 2005/0235543 | A1 | * | 10/2005 | Murello ..... 42/47 |
| 2005/0262752 | A1 | * | 12/2005 | Robinson et al. ..... 42/71.01 |
| 2006/0037464 | A1 | * | 2/2006 | Moore ..... 89/125 |

* cited by examiner

*Primary Examiner* — Bret Hayes
(74) *Attorney, Agent, or Firm* — Holland & Hart

(57) ABSTRACT

A bolt for a firearm is described that can be used to chamber, extract, and/or eject different cartridges that have different outside rim diameters. In one embodiment, the bolt includes a bolt head that is configured to engage the rearward end of a plurality of different cartridges. The bolt may include an extractor that is configured to engage the rims of the plurality of cartridges and/or an ejector that is configured to bias the cartridge case out of an ejection port of the firearm.

34 Claims, 6 Drawing Sheets

MULTI-CALIBER BOLT FOR A FIREARM

CROSS REFERENCE TO RELATED PATENT APPLICATIONS

U.S. patent application Ser. No. 11/971,706, entitled "Takedown Rifle," filed on 9 Jan. 2008, is hereby incorporated by reference herein in its entirety (the "Takedown Rifle Application").

BACKGROUND

Conventional firearms are configured to chamber and fire a specific cartridge. If the user wishes to fire a different cartridge, the user must obtain a different firearm that is chambered to handle the cartridge. Unfortunately, it is rarely practical to obtain large numbers of firearms of varying calibers. Instead, most people carefully evaluate what the firearm will be used for and select the cartridge that best meets the majority of the user's needs. For example, someone who uses the firearm primarily for African game is likely to choose a magnum caliber, while someone who uses the firearm primarily for varmint hunting is more likely to choose a lighter, faster, standard caliber.

It should be noted that the term "caliber" can have a variety of different meanings. For example, the caliber may refer to: (1) the approximate size of the bullets fired through a firearm (e.g., .17 caliber bullets; the actual diameter of .17 caliber bullets is 0.177 inches), (2) the approximate size of the inside diameter of the barrel of the firearm (e.g., a .30 caliber rifle; the actual inside diameter of the barrel of a .30 caliber rifle is 0.308 inches), or (3) the specific cartridge that the firearm is configured to chamber (e.g., .300 Winchester Magnum). For example, a rifle that is configured to fire 30-06 cartridges may be appropriately referred to as simply a .30 caliber rifle because that is the approximate size in inches of the bullets (the actual size of the bullets is 0.308 inches) and the inside diameter of the barrel. However the same rifle may also be appropriately referred to as being a 30-06 caliber rifle since that is the specific cartridge that the rifle is chambered for.

Some conventional firearms are capable of firing more than one caliber of cartridges. For example, most .357 magnums are also capable of firing .38 special cartridges. The primary difference between the two cartridges is that the .38 special is significantly shorter. Otherwise, the diameter of the bullets and the outside diameter of the rims of the two cartridges are the same. Most firearms that can fire multiple cartridges involve situations such as this where the cartridges are very similar or identical in size, particularly the outside diameter of the bullet and the rim of the cartridge case (e.g., a .22 long rifle caliber firearm can usually fire .22 shorts and .22 longs).

It would be desirable to provide a firearm that is capable of firing a much wider variety of cartridges. Such a firearm may eliminate or reduce the perceived need to buy multiple firearms depending on how the firearm is intended to be used.

SUMMARY

A bolt and associated firearms that incorporate the bolt are described herein. The bolt may allow the firearms to fire and cycle cartridges that have cases with different outside diameters. This allows the user to purchase a single firearm that can be used for multiple purposes such as varmint hunting and big game hunting.

In one embodiment, a firearm comprises a bolt that may include an extractor and an ejector. The extractor may be configured to engage a rim of a cartridge. The ejector may be configured to bias a base of the cartridge away from the bolt. The extractor may also be configured to move outward in a direction that is perpendicular to a lengthwise axis of the bolt to accommodate cartridges having different outside rim diameters. In another embodiment, a rifle comprises a bolt that may be configured to chamber, extract, and eject cartridge cases having different outside rim diameters. In another embodiment, a bolt for a firearm may comprise a bolt head configured to contact a base of a cartridge in order to chamber the cartridge, an extractor configured to engage a rim of the cartridge, and an ejector configured to bias the base of the cartridge away from the bolt head. The extractor may be configured to move outward from the center of the bolt to accommodate cartridges having different outside rim diameters.

The foregoing and other features, utilities, and advantages of the subject matter described herein will be apparent from the following more particular description of certain embodiments as illustrated in the accompanying drawings.

DRAWINGS

DETAILED DESCRIPTION

A bolt for a firearm may be provided to allow the firearm to chamber, fire, extract, and/or eject a variety of cartridges of different sizes. It should be appreciated at the outset that the configuration of the various components may be altered in any suitable way to obtain additional embodiments. For example, the firearm shown in FIG. 1 has a lever action. However, the bolt may be used with other firearms and/or actions such as bolt actions, and the like. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein.

Figure 1:
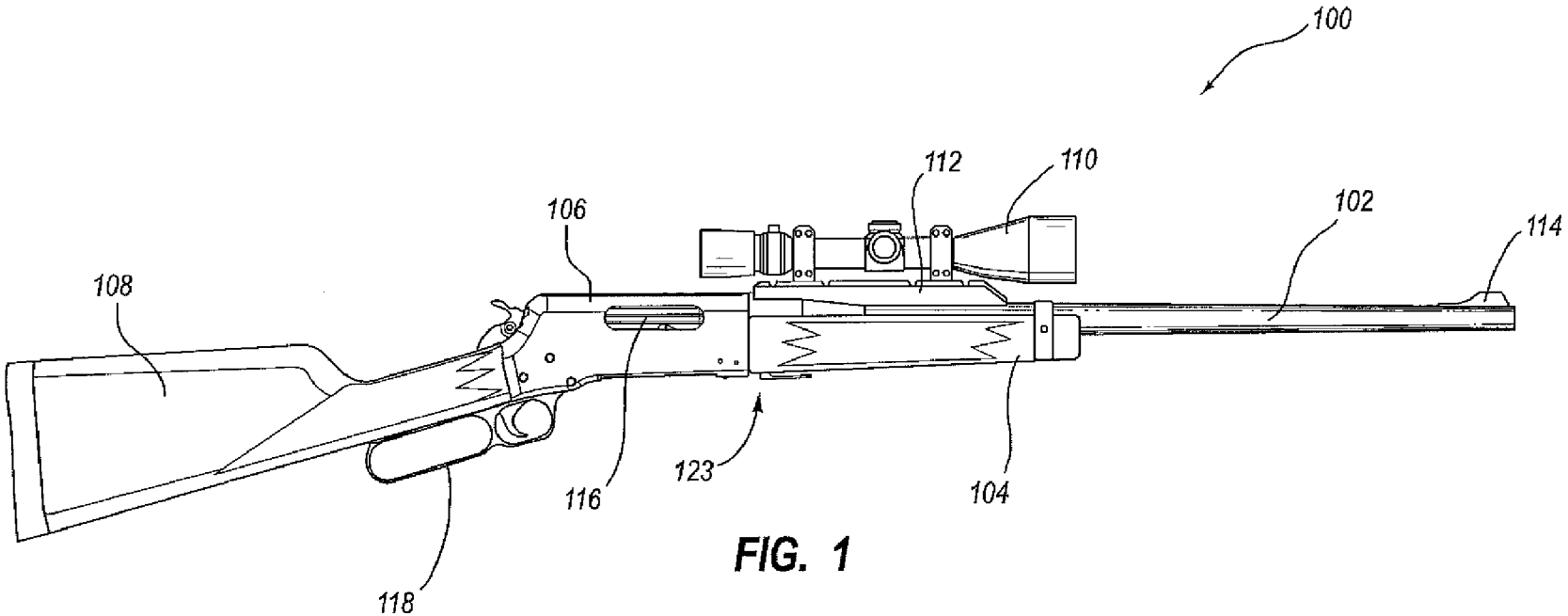
FIG. 1 is a perspective view of one embodiment of a firearm that is capable of firing multiple cartridges having cases with different outside rim diameters.
Figure 2:
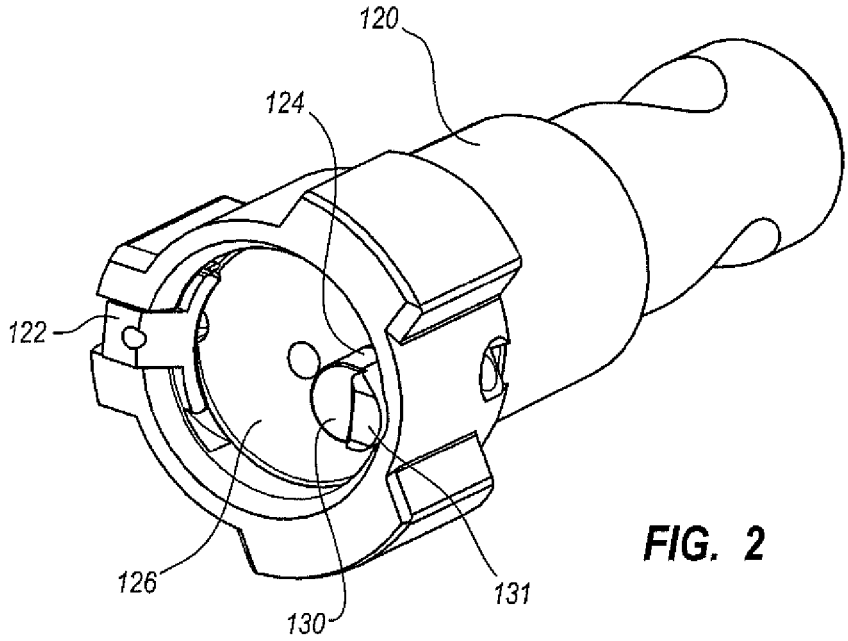
FIG. 2 shows a perspective view of one embodiment of a multi-caliber bolt.

FIG. 1 shows a perspective view of one embodiment of a firearm 100, and more specifically a rifle. The firearm 100 includes a barrel 102 coupled to a forearm 104 and a receiver 106 coupled to a stock 108. The firearm 100 is also fitted with a scope mount 112 and a scope 110 as well as iron sights 114. The scope 110 is shown in FIG. 1 coupled to the barrel 102. However, the scope 110 can also be coupled to the receiver 106.

In one embodiment, the firearm 100 may be a takedown rifle such as the one described in the Takedown Rifle Application referenced above. A takedown rifle is a rifle that is designed to be easily separated into two halves or parts to make it easy to transport, clean, store, or otherwise handle the rifle 100. A lever mechanism 123 may be used to selectively couple and decouple the two halves together. In one embodiment, the barrel 102 of the firearm 100 is interchangeable with other barrels of different calibers. This allows the user to change the caliber of the firearm 100 quickly and easily in response to the circumstances and needs at the time. In one embodiment, the firearm 100 may be changed between any of the following calibers: 22-250 Rem., 243 Win., 7 mm-08 Rem., 308 Win., 358 Win., 270 Win., 30-06 spfld., 7 mm Rem. Mag, 300 Win Mag., 300 WSM (Win. Short Magnum), 270 WSM, 7 mm WSM, 450 Marlin, 325 WSM. Each of these calibers corresponds to a standard rim diameter.

The firearm 100 includes a bolt assembly 116 that is operated with a lever 118 to eject a spent cartridge and load the chamber with a fresh cartridge. The bolt assembly 116 includes a bolt 120 that is configured to chamber, extract, and/or eject any of a variety of cartridges having a variety of standard rim diameters. As is well known in the art, standard rim diameters may have small standard dimensional deviations due to the manufacturing process. In one embodiment, the bolt 120 may be configured to chamber, extract, and/or eject cartridge cases that have different outside rim diameters. The outside rim diameters of the cartridges may be any diameter for any known rifle caliber. In one embodiment, the bolt 120 may be configured to accommodate cartridges where the outside diameter of the rim is 0.473 inches (12.01 mm) to 0.532 inches (13.51 mm). In another embodiment, the bolt 120 may be configured to accommodate cartridges where the outside diameter of the rime is 0.378 inches (9.60 mm) to 0.804 inches (20.42 mm). It should be appreciated that the diameter of the recess in a bolt head 126 will be slightly larger than the diameter of the largest rim that the bolt head 126 is designed to accommodate. This is done to eliminate any potential for the rim of a cartridge to get jammed in the recess of the bolt head 126.

The bolt 120 includes an extractor 122 and an ejector 124 positioned on the bolt head 126. The extractor 122 is positioned to engage the rim of the cartridge to pull it rearward out of the chamber. The ejector 124 is biased with the biasing member or spring 128 to push the base of the cartridge away from the bolt head 126 and out of an ejection port in the receiver of the firearm 100. The ejector 124 includes a first face 130 that the base of cartridges having a first diameter press against when the cartridges are in the chamber. The ejector also has a second face 131 against which cartridges of a second diameter are pressed when the cartridges are in the chamber. In one embodiment, the ejector 124 has a stepped shape (surfaces 130 and 131) that provides greater biasing force to larger cartridges and less biasing force to smaller cartridges. Further, a wall 133 maintains cartridges of a smaller diameter in a fixed position relative to the bolt 120.

Figure 3:
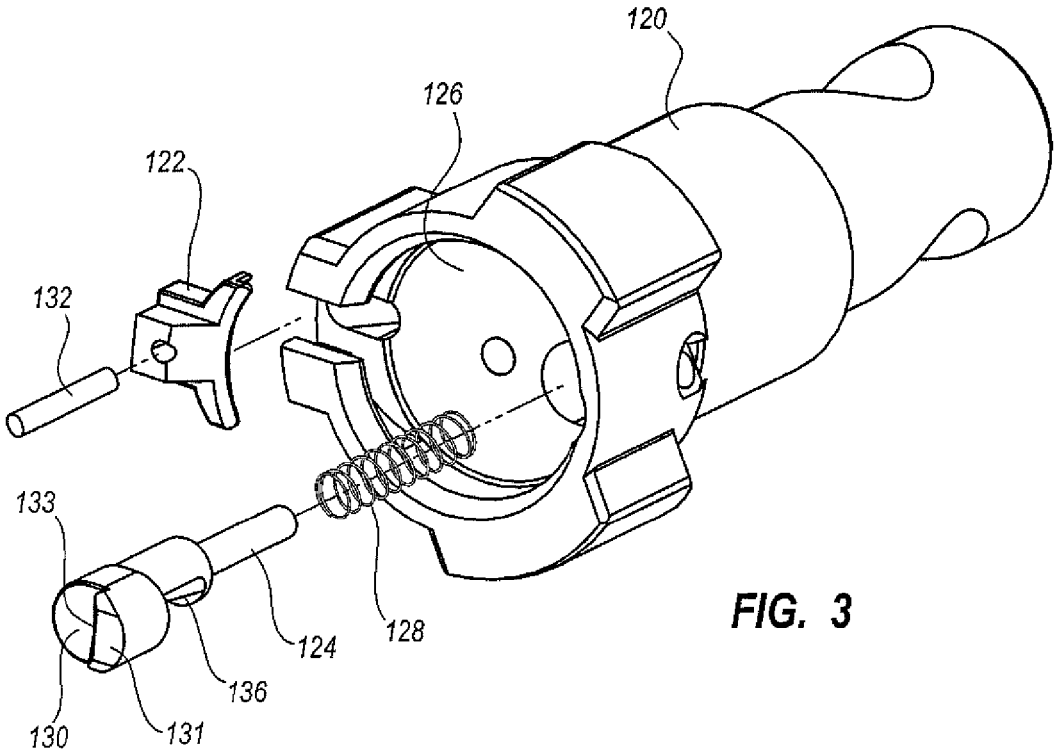
FIGS. 3 and 4 show exploded views of the multi-caliber bolt from FIG. 2
Figure 4:
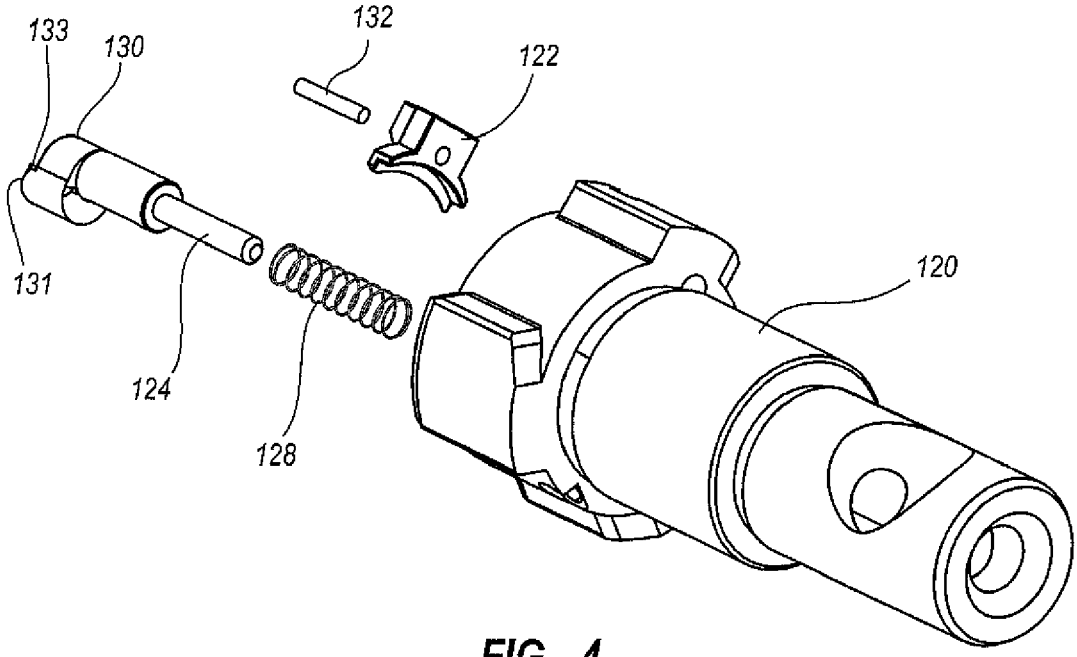
Figure 5:
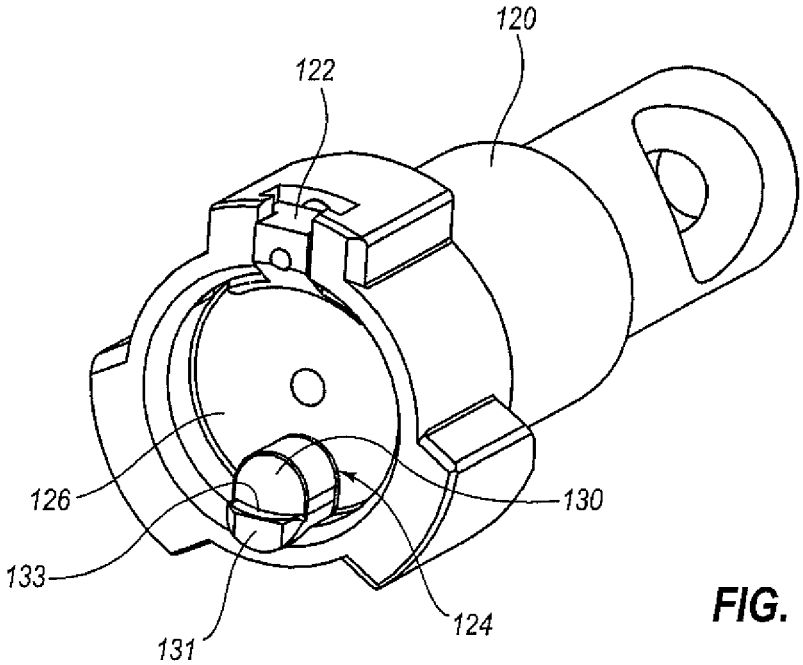
FIGS. 5-14 show additional views of the multi-caliber bolt from FIG. 2
Figure 6:
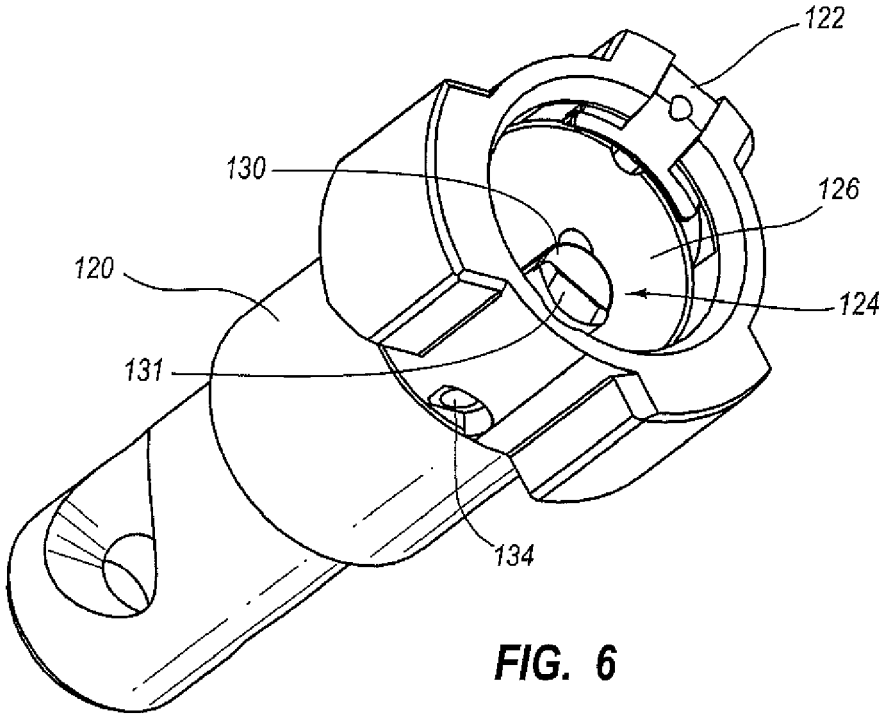
Figure 7:
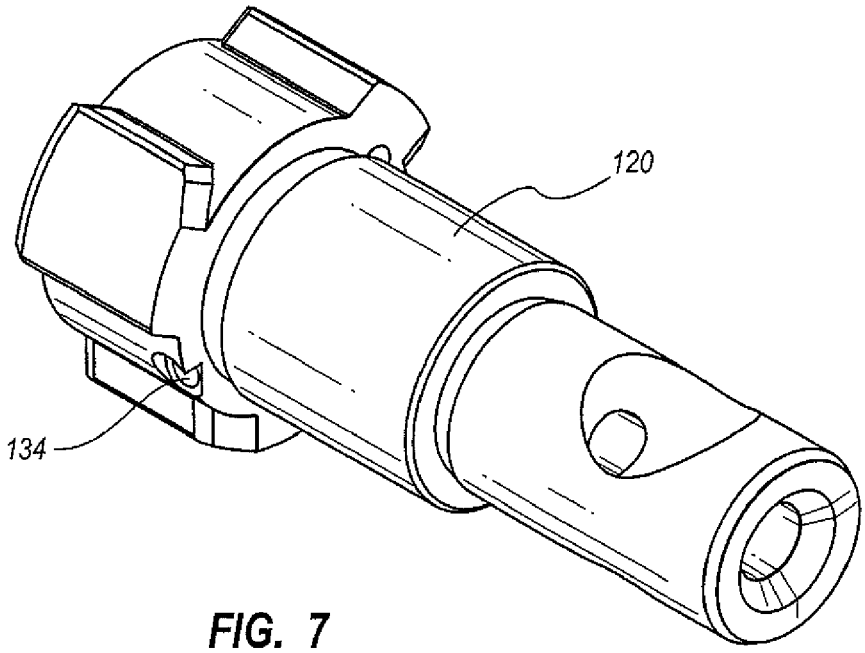
Figure 8:
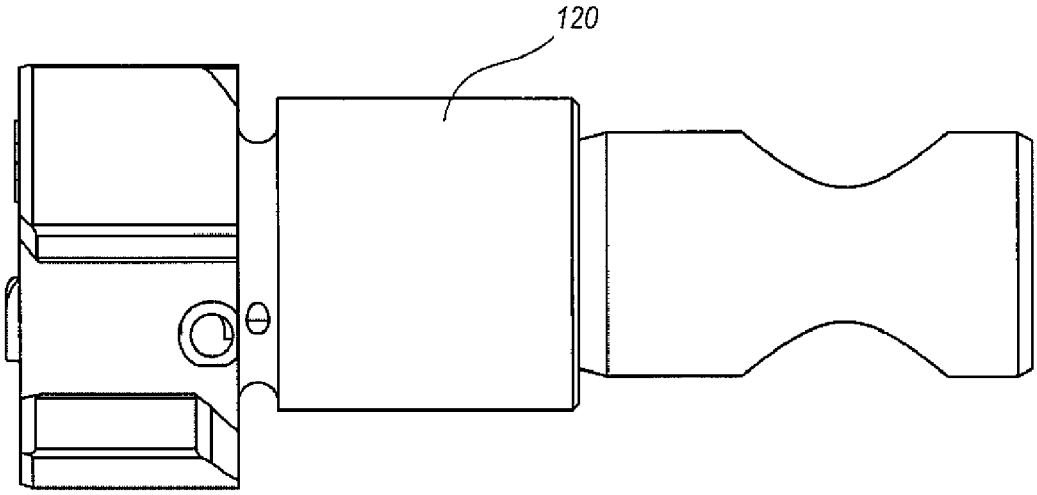
Figure 9:
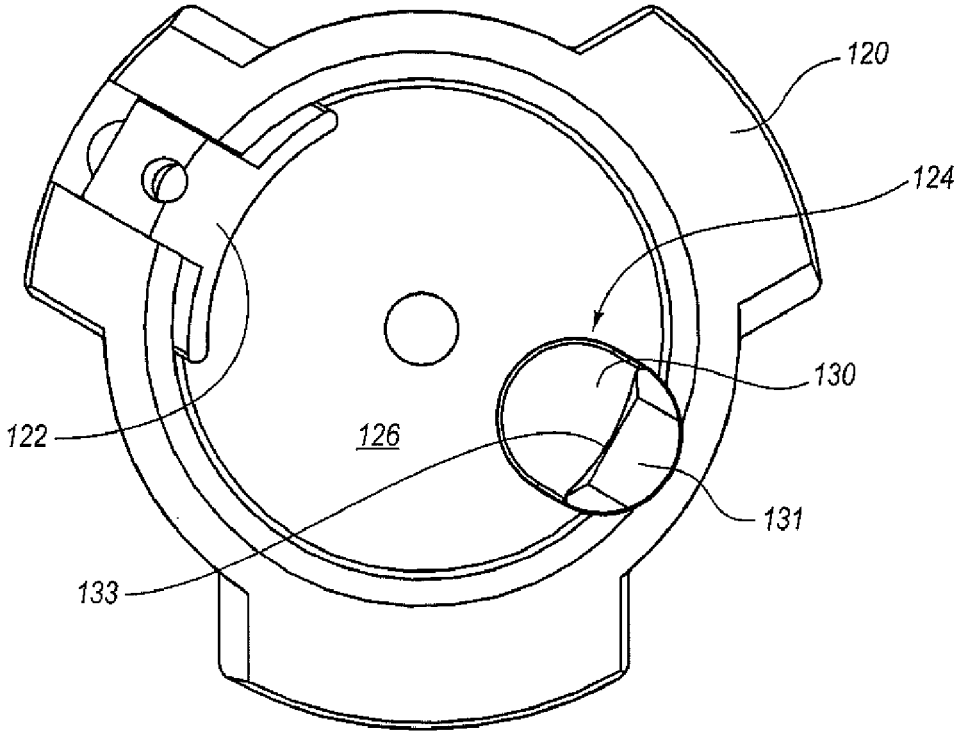
Figure 13:
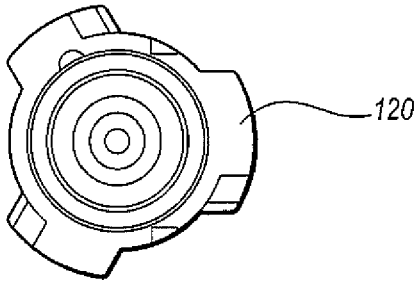
Figure 11:
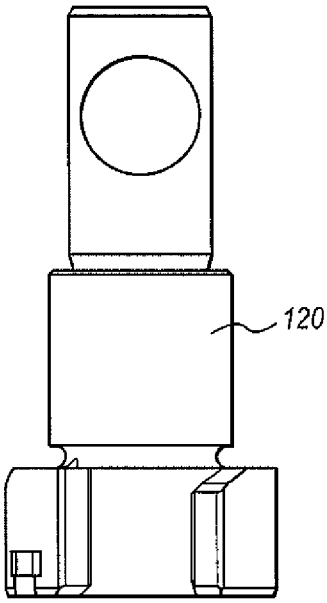
Figure 10:
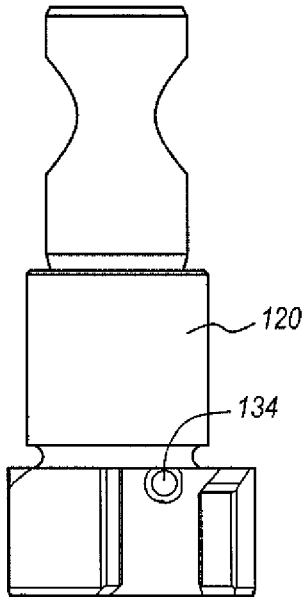
Figure 12:
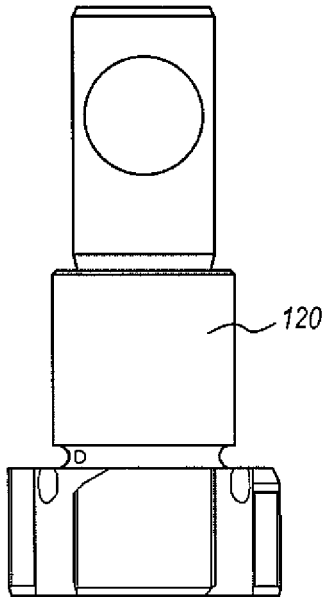
Figure 14:
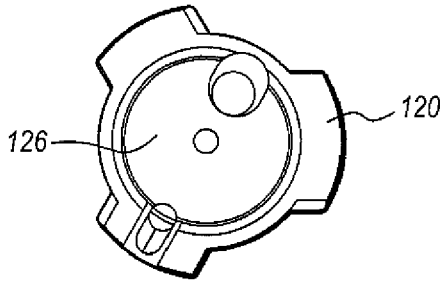

The extractor 122 is biased toward the center of the bolt head 126 (i.e., in a direction that is perpendicular to the lengthwise axis of the bolt 120) by a biasing member 132. As shown in FIGS. 3 and 4, the biasing member 132 is a resilient rod. The biasing member 132 is flexed when the extractor 122 moves outward from the center of the bolt head 126 due to the presence of a cartridge having a rim that is relatively large in diameter. As soon as the cartridge is ejected, the extractor 122 moves toward the center of the bolt head 126. The range of movement of the ejector 124 is restrained by a pin that extends through an opening 134 the bolt 120. The pin extends through a recess 136 in the ejector 124. The recess 136 is elongated to allow the ejector 124 to move toward and away from the face of the bolt head 126 in a direction that is parallel to the lengthwise axis of the bolt 120.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment, a firearm comprises: a bolt including an extractor that is configured to engage a rim of a cartridge and an ejector that is configured to bias a base of the cartridge away from the bolt; wherein the extractor is configured to move outward to accommodate cartridge cases having different outside diameters. The bolt may be capable of extracting and ejecting cartridge cases that have an outside diameter of 0.378 inches (9.60 mm) to 0.804 inches (20.42 mm). The bolt may be capable of extracting and ejecting cartridge cases that have an outside diameter of 0.473 inches (12.01 rum) to 0.532 inches (13.51 mm). The ejector may include a face that is positioned to contact the base of the cartridge, wherein the face of the ejector has a stepped shape. The extractor may be biased inward toward a center of a bolt head. The firearm may comprise a spring that is used to bias the ejector outward from the bolt.

According to another embodiment, a rifle comprises: a bolt that is configured to chamber, extract, and eject cartridge cases having different outside diameters. The bolt may be capable of chambering, extracting and ejecting cartridge cases that have an outside diameter of 0.378 inches (9.60 mm) to 0.804 inches (20.42 mm). The bolt may be capable of chambering, extracting and ejecting cartridge cases that have an outside diameter of 0.473 inches (12.01 mm) to 0.532 inches (13.51 mm). The bolt may be a rotary bolt. The bolt may include an extractor that is movable outward to allow the extractor to engage the rims of the cartridge cases having different outside diameters. The bolt may include an ejector that is configured to bias the bases of the cartridge cases away from a bolt head.

According to another embodiment, a firearm comprises: a bolt head configured to contact a base of a cartridge in order to chamber the cartridge; an extractor configured to engage a rim of the cartridge; and an ejector configured to bias the base of the cartridge away from the bolt head; wherein the extractor is configured to move outward to accommodate cartridge cases having different outside diameters. The extractor may be configured to accommodate cartridge cases having outside diameters of 0.378 inches (9.60 mm) to 0.804 inches (20.42 mm). The extractor may be configured to accommodate cartridge cases having outside diameters of 0.473 inches (12.01 mm) to 0.532 inches (13.51 mm). The bolt may be a rotary bolt. The ejector may have a face that biases the base of the cartridge away from the bolt head, wherein the face has a stepped shape. The extractor may be biased toward the center of the bolt head.

As used herein, spatial or directional terms, such as "let" "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A firearm comprising:

a bolt including an extractor that is configured to engage a rim of a cartridge and an ejector that is configured to bias a base of the cartridge away from the bolt;

wherein the extractor is configured to move outward in a direction that is perpendicular to a lengthwise axis of the bolt and a distance that is sufficient to accommodate cartridges having rim diameters within the range of 0.473 inches to 0.532 inches.

2. The firearm of claim 1 wherein the ejector includes a face that is positioned to contact the base of the cartridge, wherein the face of the ejector has a stepped shape.

3. The firearm of claim 1 wherein the extractor is biased inward toward the center of a bolt head.

4. The firearm of claim 1 comprising a spring that is used to bias the ejector outward from the bolt.

5. The firearm of claim 1 wherein the firearm is a rifle.

6. The firearm of claim 1 comprising a chamber and a barrel, wherein the barrel remains in a fixed position as the bolt cycles a cartridge through the chamber.

7. A rifle comprising:

a stock;

a barrel securable to the stock;

a bolt operatively coupled to the barrel and the stock, and configured to chamber, extract, and eject cartridges having a variety of rim diameters, wherein each rim diameter is a standard rim diameter that may have small dimensional deviations due to the manufacturing process;

wherein the bolt includes an extractor that is movable outward to allow the extractor to engage the cartridges having different outside rim diameters.

8. The rifle of claim 7 wherein the bolt is capable of chambering, extracting and ejecting cartridges that have an outside rim diameter of 0.473 inches to 0.532 inches.

9. The rifle of claim 7 wherein the bolt is a rotary bolt.

10. The rifle of claim 7 wherein the bolt includes an ejector that is configured to bias the bases of the cartridges away from a bolt head.

11. The rifle of claim 7 comprising a chamber and a barrel, wherein the barrel remains in a fixed position as the bolt cycles a cartridge through the chamber.

12. A bolt for a firearm comprising:

a bolt head configured to contact a base of a cartridge in order to chamber the cartridge;

an extractor configured to engage a rim of the cartridge; and an ejector configured to bias the base of the cartridge away from the bolt head;

wherein the extractor is configured to move outward in a direction that is perpendicular to a lengthwise axis of the bolt and a distance that is sufficient to accommodate cartridges having a variety of rim diameters, wherein each rim diameter is a standard rim diameter that may have small dimensional deviations due to the manufacturing process.

13. The bolt of claim 12 wherein the extractor is configured to accommodate cartridges having outside rim diameters of 0.473 inches to 0.532 inches.

14. The bolt of claim 12 wherein the bolt is a rotary bolt.

15. The bolt of claim 12 wherein the ejector has a face that biases the base of the cartridge away from the bolt head, wherein the face has a stepped shape.

16. The bolt of claim 12 wherein the extractor is biased toward the center of the bolt head.

17. A firearm comprising:

a chamber sized to receive a cartridge;

a bolt that moves a cartridge into and out of the chamber;

an extractor that engages a rim of the cartridge to extract the cartridge from the chamber;

an ejector that biases a base of the cartridge away from the bolt;

wherein the extractor moves outward from a lengthwise axis of the bolt to accommodate cartridges having different outside standard rim diameters, wherein each cartridge corresponds to a standard rim diameter;

wherein the ejector includes a first face that contacts the base of cartridges having outside rim diameters smaller than a certain size and a second face that contacts the base of cartridges having outside rim diameters larger than the certain size.

18. The firearm of claim 17 wherein the bolt is capable of extracting and ejecting cartridges that have an outside rim diameter of 0.473 inches to 0.532 inches.

19. The firearm of claim 17 wherein the extractor is biased inward toward the lengthwise axis of the bolt.

20. The firearm of claim 17 comprising a spring that biases the ejector outward from the bolt.

21. The firearm of claim 17 wherein the firearm is a rifle.

22. The firearm of claim 17 comprising a barrel, wherein the barrel remains in a fixed position as the bolt moves a cartridge into and out of the chamber.

23. A firearm comprising:

a chamber sized to receive a cartridge;

a bolt that moves a cartridge into and out of the chamber;

an extractor that engages a rim of the cartridge to extract the cartridge from the chamber;

an ejector that biases a base of the cartridge away from the bolt;

wherein the ejector includes a first face that contacts the base of cartridges having outside rim diameters smaller than a certain size and a second face that contacts the base of cartridges having outside rim diameters larger than the certain size, wherein each cartridge corresponds to a standard rim diameter.

24. The firearm of claim 23 wherein the bolt is capable of extracting and ejecting cartridges that have an outside rim diameter of 0.473 inches to 0.532 inches.

25. The firearm of claim 23 comprising a spring that biases the ejector outward from the bolt.

26. The firearm of claim 23 wherein the firearm is a rifle.

27. The firearm of claim 23 comprising a barrel, wherein the barrel remains in a fixed position as the bolt moves a cartridge into and out of the chamber.

28. A firearm comprising:

a bolt including an extractor that is configured to engage a rim of a cartridge and an ejector that is configured to bias a base of the cartridge away from the bolt;

wherein the extractor is configured to move outward in a direction that is perpendicular to a lengthwise axis of the bolt and a distance that is sufficient to accommodate cartridges having different rim diameters within the range of about 0.378 inches to about 0.804 inches.

29. The firearm of claim 28 wherein the ejector includes a face that is positioned to contact the base of the cartridge, wherein the face of the ejector has a stepped shape.

30. The firearm of claim 28 wherein the extractor is biased inward toward the center of a bolt head.

31. The firearm of claim 28 comprising a spring that is used to bias the ejector outward from the bolt.

32. A firearm comprising:

a stock;

a barrel securable to the stock;

a bolt operatively coupled to the barrel and the stock, and including means for engaging and chambering cartridges of different standard rim diameters, the means including at least an extractor and an ejector.

33. The firearm of claim 32 wherein the extractor is movable outward to engage the cartridges.

34. The firearm of claim 32 wherein the ejector is configured to bias the bases of the cartridges away from a bolt head.

* * * * *